US010006640B2

(12) United States Patent
Neukamm et al.

(10) Patent No.: US 10,006,640 B2
(45) Date of Patent: Jun. 26, 2018

(54) REGULATOR ASSEMBLY AND STOVE

(75) Inventors: Alwin Neukamm, Wilhermsdorf (DE); Stefan Bayerlein, Feuchtwangen (DE)

(73) Assignee: Electrolux Home Products Corporation N.V., Brussels (BE)

( * ) Notice: Subject to any disclaimer, the term of this patent is extended or adjusted under 35 U.S.C. 154(b) by 1374 days.

(21) Appl. No.: 13/131,663

(22) PCT Filed: Oct. 27, 2009

(86) PCT No.: PCT/EP2009/007660

§ 371 (c)(1),
(2), (4) Date: Sep. 9, 2011

(87) PCT Pub. No.: WO2010/063346

PCT Pub. Date: Jun. 10, 2010

(65) Prior Publication Data

US 2011/0309065 A1 Dec. 22, 2011

(30) Foreign Application Priority Data

Dec. 3, 2008 (EP) ..... 08020947

(51) Int. Cl.

| | |
|---|---|
| ***H05B 3/68*** | (2006.01) |
| ***H05B 3/06*** | (2006.01) |
| ***F24C 15/10*** | (2006.01) |
| ***H02G 3/08*** | (2006.01) |
| ***F24C 7/08*** | (2006.01) |

(52) U.S. Cl.

CPC ..... *F24C 15/105* (2013.01); *F24C 7/082* (2013.01)

(58) Field of Classification Search

CPC .. F24C 7/08; F24C 7/081; F24C 7/082; F24C 7/083; F24C 15/104; F24C 1/1055; F24C 15/105; F24C 15/10; H05B 3/06; H05B 3/68; H02G 3/08

USPC ..... 219/445.1, 480; 126/124 A, 214 A, 126/214 B, 211, 214 R–220; 174/50–50.54; 361/730

See application file for complete search history.

(56) References Cited

U.S. PATENT DOCUMENTS

| | | | | |
|---|---|---|---|---|
| 3,900,712 A | | 8/1975 | Fukao | |
| 6,050,176 A | * | 4/2000 | Schultheis | H05B 3/74 126/39 K |

(Continued)

FOREIGN PATENT DOCUMENTS

| | | |
|---|---|---|
| CN | 1465901 A | 1/2004 |
| DE | 7203985 | 8/1972 |

(Continued)

OTHER PUBLICATIONS

German to English translation of EP 1113101.*

International Search Report for PCT/EP2009/007660, dated Dec. 4, 2009, 2 pages.

*Primary Examiner* — Michael Hoang

(74) *Attorney, Agent, or Firm* — Pearne & Gordon LLP

(57) ABSTRACT

A regulator assembly which includes a housing for accommodating at least two regulators, wherein the housing has receptacles formed therein, into which the regulators can be inserted from an open side of the housing, where each receptacle has associated therewith retaining elements, which are positioned to elastically engage side faces of the regulator to be inserted into the receptacle so that the regulator is positioned and/or fixed in the receptacle.

21 Claims, 3 Drawing Sheets

(56) References Cited

U.S. PATENT DOCUMENTS

Figure 1:
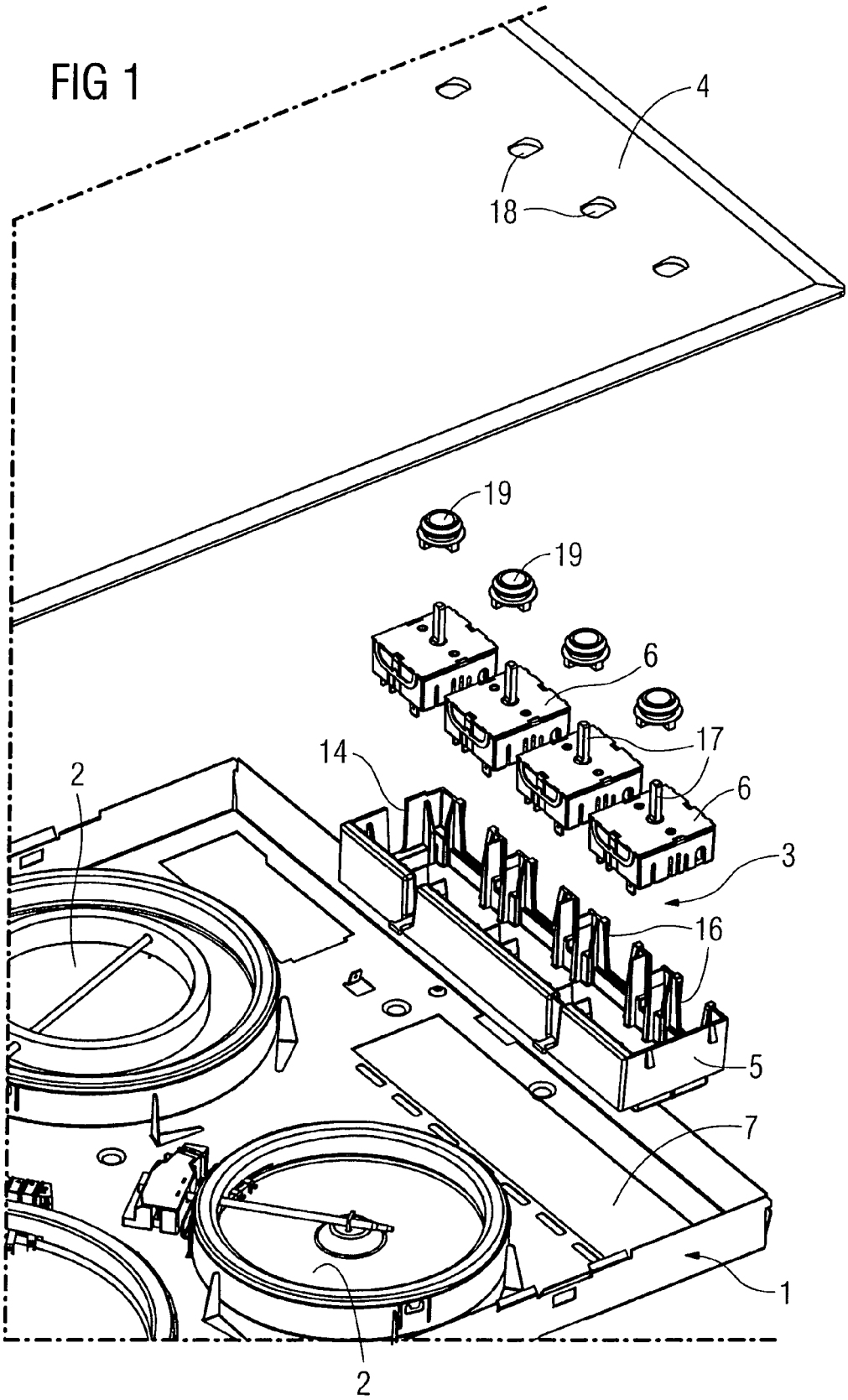

| | | | | |
|---|---|---|---|---|
| 7,401,610 | B1 * | 7/2008 | Cherry | 126/42 |
| 2005/0194004 | A1 * | 9/2005 | Boswell | F24C 15/102 126/211 |
| 2009/0045590 | A1 * | 2/2009 | Ueta et al. | 277/595 |
| 2009/0293233 | A1 * | 12/2009 | Ho et al. | 24/129 R |
| 2010/0020507 | A1 * | 1/2010 | Pianezze | 361/728 |

FOREIGN PATENT DOCUMENTS

| | | |
|---|---|---|
| DE | 29515351 | 11/1995 |
| EP | 1113101 | 7/2001 |
| EP | 0930467 B1 | 4/2004 |
| EP | 1545177 | 6/2005 |

* cited by examiner

REGULATOR ASSEMBLY AND STOVE

TECHNICAL FIELD

The present invention relates to a regulator assembly which comprises a housing for accommodating at least two regulators, wherein the housing has receptacles formed therein, into which the regulators can be inserted from an open side of the housing. The present invention further relates to a stove comprising a regulator assembly.

BACKGROUND TECHNOLOGY

Regulators of the above kind are widely used in stoves to allow an easy assembly of the stove. They have a housing which is provided with receptacles to accommodate the required number of regulators for the particular stove. The regulators are mounted in the receptacles to form pre-assembled units, which can then be easily mounted to the stove.

In the previous regulator assemblies the regulators are mounted to the housing by means of screws. Accordingly, each regulator needs to be exactly positioned so that the screws can be fitted into corresponding screw holes. When it is desired to alternatively mount different kinds of regulators in the housing, the housing has to be provided with screw holes fitted for all these regulators. Since usually the screw holes of different regulators are provided in different positions the number of screw holes needs to be comparatively high, even when the outer dimension of the regulators are identical.

Furthermore, the screws have to be mounted using a defined torque. If the torque is exceeded, the threaded portion of the screw or the corresponding screw hole can be damaged. In contrast, if the regulator is mounted with an insufficient torque, the regulator will wobble in the receptacle. A user who operates the regulator will feel the wobbling, which is not acceptable due to safety and quality restraints.

The screws can furthermore loosen due to thermal influences. Especially with the high temperatures generated in stoves, materials underlie high temperature oscillations. This leads to frequent expansion and shrinking of the housing and/or the screws and causes the screws to loosen.

Especially when the mounting portion of the housing for mounting the regulator is rather thin, the portion between the screw head and the threaded portion of the screw may be larger than the thickness of the mounting portion. In this case situations can occur in which the screw is already tightened up in the screw hole, but the screw head is not yet in tight contact to fix the regulator in the receptacle.

Accordingly it is an object of the present invention to provide a regulator assembly and a stove of the above mentioned kind, wherein the regulators can be easily mounted to the housings.

DISCLOSURE OF THE INVENTION

This object is solved by that each receptacle has associated thereto retaining elements, which are positioned to elastically engage side faces of the regulator to be inserted into the receptacle, so that the regulator is positioned and/or fixed in the receptacle. The object of the present invention is also solved by a stove with such a regulator assembly.

The basic idea of the invention is to position and resiliently hold the regulators in the housing by the retaining elements. In this way the regulators can be easily mounted by merely inserting them into the receptacles of the housing, where they are automatically fixed and positioned by retaining elements. Accordingly, the use of screws is not required. Moreover the retaining elements can be designed to hold regulators with varying dimensions, so that different regulators can be used without necessitating any modifications of the housing.

Additionally, a maintenance of the stove is improved since a regulator can be easily replaced.

Preferably each receptacle has associated thereto guiding elements, which guide the insertion of the regulators into the corresponding receptacle. In this way, the insertion of the regulators can be quickly and easily realised.

Furthermore, the guiding elements can be bevelled and provide tapered openings for the insertion of the regulators. Accordingly, the opening is wide at the open side of the housing, so that the regulator can be easily inserted and positioned in the corresponding receptacle. When the regulator is further pushed into the receptacle, the size of the opening reduces and the regulator is accurately guided along the bevelled guiding elements to its predetermined position.

According to a further embodiment the guiding elements and the retaining elements are positioned at different lateral sides of the respective receptacle. This allows an easy combination of guiding elements and retaining elements without interfering with each other.

Additionally, support elements can be provided for supporting a bottom of the regulators in the receptacles. The support elements provide abutment faces for supporting the regulators at predefined axial positions.

Further, at least one cable inlet can be provided for leading through at least one cable for electrically connecting through the regulators. Since the regulators need to be connected at least to a control or power cable for operation, these cables can be passed through the cable inlet in a convenient way.

In a further embodiment at least one vent hole, particularly one vent hole per regulator, is provided for cooling the regulators. Especially power regulators generate heat when being operated, and since the housing is usually rather small, the heat might easily be accumulated, which can lead to thermal damages of the housing or the regulator itself. This can be avoided by the vent holes, so that heat can be conveyed away.

Preferably, each receptacle has associated thereto at least one elastic element, which is supported between an outer wall of the stove and the corresponding regulator to urge the regulator into the receptacle. In other words according to this embodiment the regulator is pressed against the bottom of the receptacle by the resilient force of the elastic element, so that a proper axial position of the regulator in the receptacle is guaranteed.

The elastic elements are especially useful when the regulator assembly is arranged with the open side of the housing facing to a lateral side of the stove. In this case gravity does not drag the regulators into the receptacles, and it is even more important to reliably urge the regulators into the receptacle by the pressure exerted from the elastic elements. Accordingly, tilting of the regulators in the receptacles is avoided independent from the orientation of the housing.

Furthermore, in a manner known per se each regulator can comprise a protruding operating element, which extends through a corresponding hole in the outer surface of the stove. The operating element is usually a shaft, which is operated by a knob, mounted onto the shaft. In this case the corresponding elastic element can be ring shaped and surround the operating element.

Advantageously the elastic elements may be fixed in the corresponding holes in the outer wall and preferably, the elastic elements are provided as gaskets for sealing the gaps between the operating elements and the corresponding holes. In this way the position of the operating elements is secured against radial forces in respect to the holes. Also foreign matter will be prevented from entering the stove, since the gap between the hole, the elastic element and the operating element is closed.

Furthermore, the elastic elements can comprise plain bearing surfaces, which rest on the regulators. In this embodiment the elastic elements exert homogeneously pressure on the regulators to urge them into the receptacles.

Finally, the elastic elements can be made of silicon. This material is flexible and resistible to mechanical influences, so that the material characteristics can be maintained over a long operation time.

BRIEF DESCRIPTION OF THE ACCOMPANYING DRAWINGS

The detailed configuration, figures and advantages of the present invention will become apparent in the course of the following description with reference to the accompanying drawings.

Figure 2:
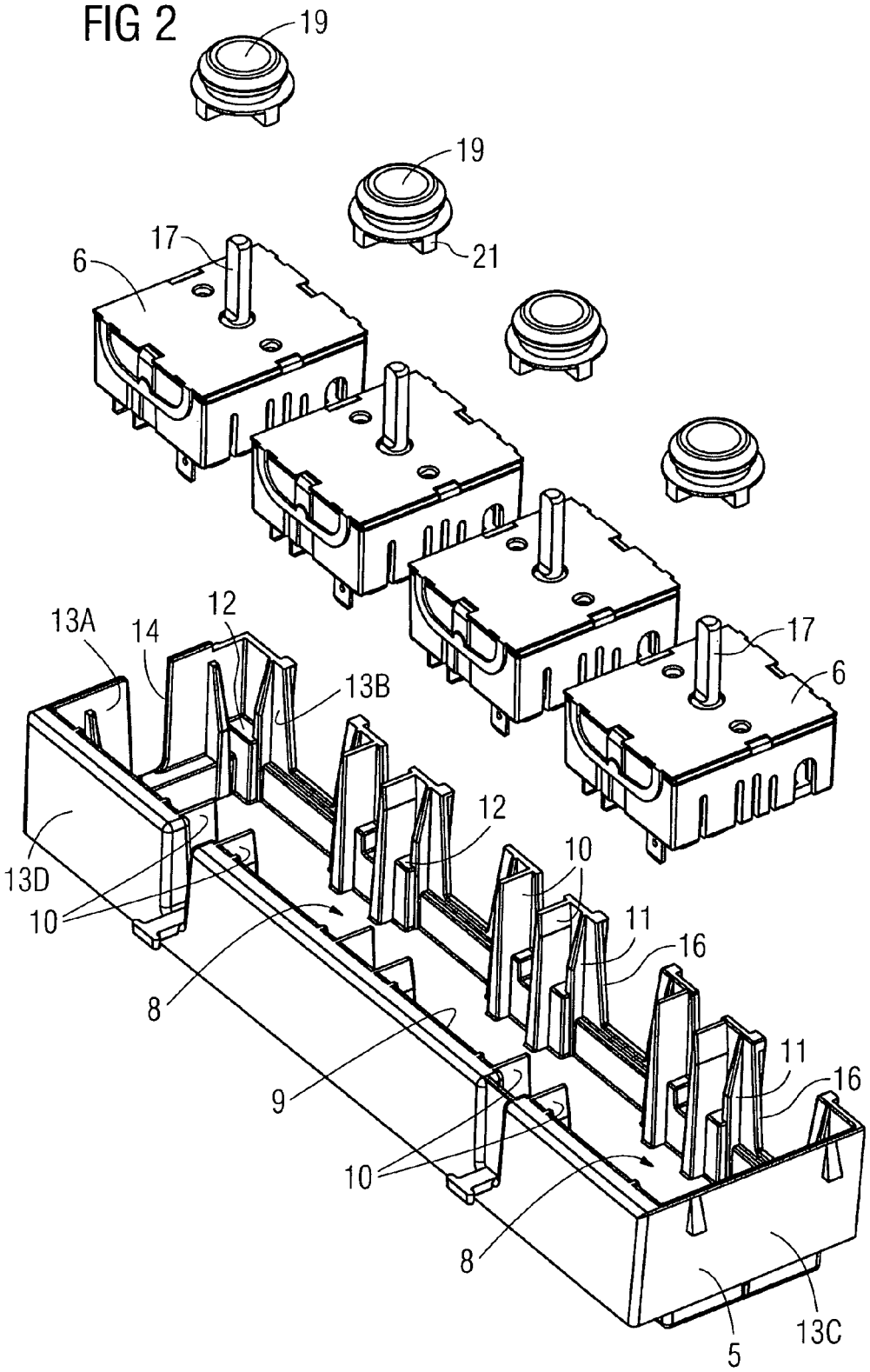
Figure 3:
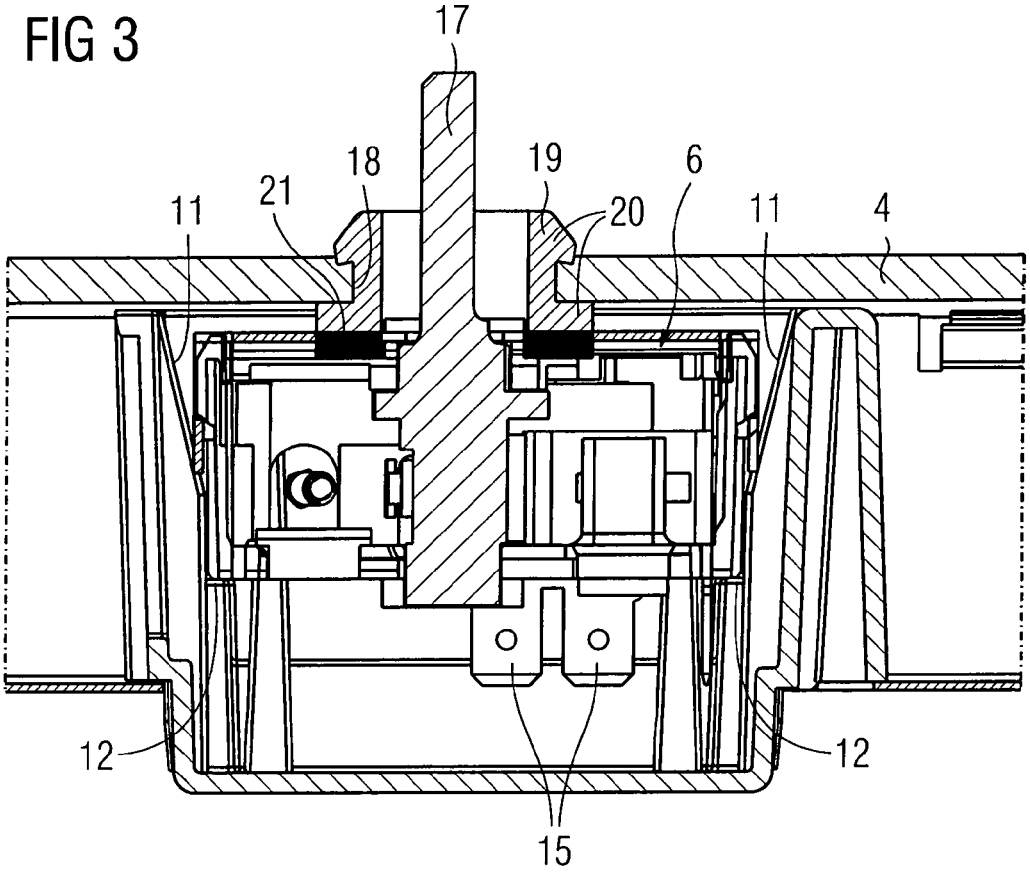

FIG. 1 is an exploded partial view of an upper part of a stove with a regulator assembly according to the present invention, FIG. 2 is a detailed exploded view of the regulator assembly from FIG. 1, and FIG. 3 is a cross-sectional view of a regulator assembly mounted into the stove.

BEST MODE FOR CARRYING OUT THE INVENTION

Below, an embodiment of the present invention will be described with reference to the figures. In the figures, like parts or portions are denoted by like reference numbers, and redundant description will be omitted.

FIG. 1 shows an upper part of a stove, which comprises a base structure 1, four cooking zones 2, which are arranged on the base structure 1, a regulator assembly 3 for actuating the cooking zones 2 and a cover plate 4. The cover plate 4 is a glass ceramic plate, which covers the base structure 1 and at the same time serves for placing cooking recipients thereon.

The regulator assembly 3 comprises a housing 5 and four regulators 6 and is fixed in a rectangular recess 7 of the base structure 1.

The housing 5 comprises four receptacles 8 for accommodating the regulators 6. The receptacles 8 are open towards the upper side 9 of the housing 5 and have associated thereto retaining elements 10, which are arranged and positioned to elastically engage side faces of the regulators 6 to be inserted.

The receptacles 8 have further associated thereto bevelled guiding elements 11, which provide tapered openings for guiding the insertion of the regulators 6 into the receptacles 8. The cross section of the openings increases towards the open side 9 of the housing 5.

The axial end of the receptacles 8 is defined by support elements 12, which form the bottom of the receptacles 8 and an axial abutment face for the regulators 6.

The retaining elements 10 on the one hand and the guiding elements 11 on the other hand are positioned at different sides of the receptacles 8. Specifically the retaining elements 10 are provided between the receptacles 8, whereas the guiding elements 11 are positioned along the outer walls 13A, 13B, 13C, 13D of the housing 5.

The housing 5 further comprises one cable inlet 14, which is provided in the rear wall 13A of the housing 5. Electric contacts 15 of the regulators 6 can be connected by a cable (not shown), which passes through the cable inlet 14, to the cooking zones 2 for actuating them.

Vent holes 16 are provided along one side wall 13B of the housing 5 and correspond each to one receptacle 8. Ambient air may enter through the vent holes 16 into the housing 5 to reduce the temperature of the regulators 6 when in operation.

The regulators 6 are provided with protruding operating elements 17 in the form of shafts, which extend through corresponding through holes 18 in the cover plate 4. Knobs (not shown) are mounted on the shafts 17 to operate the regulators 6.

Each receptacle 8 has associated thereto one elastic element 19, which is made of silicon and provided in a ring shaped form. The elastic element 19 is positioned around the shaft 17 and supported between the cover plate 4 and the corresponding regulator 6. Thereby, the elastic element 19 urges the regulator 6 into the housing 5. The upper part of the elastic element 19 extends into the corresponding through hole 18, where it is securely fixed by lips 20, which extend from the hole 18 to both sides of the cover plate 4. The elastic elements 19 thereby seal the gaps between the shaft 17 of the regulator 6 and the corresponding hole 18.

The elastic element 19 comprises protruding portions 21, which provide a plane bearing surface which rest on the regulators 6. By means of the protruding portions 21 the regulator 6 is evenly urged into the receptacle 8.

The invention claimed is:

1. A regulator assembly which comprises at least two regulators and a housing configured for simultaneously accommodating the at least two regulators, each of the at least two regulators configured for actuating a corresponding spaced-apart cooking zone, wherein each of the at least two regulators comprises an operating element by which each of the at least two regulators is configured to be operated, and a knob mounted on the operating element for allowing a user to operate a corresponding regulator, wherein the housing has at least two receptacles formed therein, into which each of the at least two regulators can be respectively inserted from an open side of the housing, wherein each of the at least two receptacles has associated therewith retaining elements which are positioned to elastically engage side faces of each of the at least two regulators to be inserted into a corresponding one of the at least two receptacles so that each of the at least two regulators is at least one of positioned and fixed in the corresponding one of the at least two receptacles and at least one elastic element that is positioned between a wall and a corresponding one of the at least two regulators to urge the corresponding one of the at least two regulators away from the wall and into the corresponding one of the at least two receptacles.

2. The regulator assembly according to claim 1, wherein each of the at least two receptacles has associated therewith guiding elements which guide the insertion of each of the at least two regulators into the corresponding one of the at least two receptacles.

3. The regulator assembly according to claim 2, wherein the guiding elements are beveled and provide tapered openings for the insertion of each of the at least two regulators.

4. The regulator assembly according to claim 2, wherein the guiding elements and the retaining elements are positioned at different lateral sides of each of the at least two receptacles.

5. The regulator assembly according to claim 1, further comprising support elements for supporting a bottom of each of the at least two regulators in each of the at least two receptacles.

6. The regulator assembly according to claim 1, wherein the housing further comprises at least one cable inlet for leading through at least one cable for electrically connecting to the at least two regulators.

7. The regulator assembly according to claim 1, wherein the housing further comprises at least one vent hole for cooling the at least two regulators.

8. A stove comprising cooking zones and a regulator assembly spaced-apart from the cooking zones, wherein the regulator assembly is provided inside the stove and comprises at least two regulators and a housing configured for simultaneously accommodating the at least two regulators, each of the at least two regulators configured for actuating a corresponding one of the cooking zones, wherein each of the at least two regulators comprises an operating element by which each of the at least two regulators is configured to be operated, and a knob mounted on the operating element for allowing a user to operate a corresponding regulator, wherein the housing has at least two receptacles formed therein, into which each of the at least two regulators can be respectively inserted from an open side of the housing, wherein each of the at least two receptacles has associated therewith retaining elements which are positioned to elastically engage side faces of each of the at least two regulators to be inserted into a corresponding one of the at least two receptacles so that each of the at least two regulators is at least one of positioned and fixed in the corresponding one of the at least two receptacles and at least one elastic element that is positioned between an outer wall of the stove and a corresponding one of the at least two regulators to urge the corresponding one of the at least two regulators away from the outer wall and into the corresponding one of the at least two receptacles.

9. The stove according to claim 8, wherein each operating element is a protruding operating element which extends through a corresponding hole in the outer wall of the stove, and a corresponding one of the at least one elastic element is ring shaped and surrounds the operating element.

10. The stove according to claim 9, wherein the corresponding one of the at least one elastic element is fixed in the corresponding hole in the outer wall.

11. The stove according to claim 10, wherein the at least one elastic element is provided as a gasket for sealing a gap between the operating element and the corresponding hole.

12. The stove according to claim 9, wherein the at least one elastic element comprises lips configured to engage the corresponding hole in the outer wall of the stove.

13. The stove according to claim 8, wherein the at least one elastic element comprises a plain bearing surface which is in bearing contact with the corresponding one of the at least two regulators.

14. The stove according to claim 8, wherein the at least one elastic element is made of silicon.

15. The stove according to claim 8, wherein the retaining elements are configured to hold each of the at least two regulators in the corresponding one of the at least two receptacles, and wherein the retaining elements are designed to hold regulators of varying dimensions.

16. The stove according to claim 8, wherein each of the at least two receptacles has associated therewith guiding elements which guide the insertion of each of the at least two regulators into the corresponding one of the at least two receptacles, and wherein the guiding elements are beveled and provide tapered openings for the insertion of each of the at least two regulators.

17. The stove according to claim 8, wherein each of the at least two receptacles has associated therewith support elements for supporting a bottom of each of the at least two regulators in the corresponding one of the at least two receptacles.

18. The stove according to claim 17, wherein the at least one elastic element urges the corresponding one of the at least two regulators against corresponding support elements.

19. The stove according to claim 8, wherein each of the at least two regulators includes at least one electrical contact for connecting the regulator to the corresponding one of the cooking zones.

20. The stove according to claim 8, wherein the at least one elastic element is disposed between a bottom surface of the outer wall and the corresponding one of the at least two regulators to urge the corresponding one of the at least two regulators in a direction perpendicular to the bottom surface of the outer wall.

21. The stove according to claim 8, wherein the at least one elastic element has a C-shaped groove such that a portion of the at least one elastic element is above the outer wall and a portion of the at least one elastic element is below the outer wall.

* * * * *